United States Patent [19]

Croucher et al.

[11] Patent Number: 4,822,710

[45] Date of Patent: Apr. 18, 1989

[54] LIQUID DEVELOPER COMPOSITIONS

[75] Inventors: Melvin D. Croucher, Oakville; James M. Duff, Mississauga; John R. C. Fuller, Oakville; George R. Pravato, York; Raymond W. Wong, Mississauga, all of Canada

[73] Assignee: Xerox Corporation, Stamford, Conn.

[21] Appl. No.: 16,815

[22] Filed: Feb. 20, 1987

[51] Int. Cl.[4] ..... G03G 9/12

[52] U.S. Cl. ..... 430/115; 430/126

[58] Field of Search ..... 430/115, 126

[56] References Cited

U.S. PATENT DOCUMENTS

| | | | |
|---|---|---|---|
| 3,806,354 | 4/1974 | Amidon et al. . | |
| 3,894,958 | 7/1975 | McCoy et al. | 252/51.5 A |
| 3,939,087 | 2/1976 | Vijayendran et al. | 106/23 |
| 4,087,483 | 5/1978 | Geerdes | 524/571 X |
| 4,197,211 | 4/1980 | Amidon et al. | 430/115 |
| 4,252,882 | 2/1981 | Herrmann | 430/117 |
| 4,389,499 | 6/1983 | Reisgraf | 525/89 X |
| 4,425,418 | 1/1984 | Iwaki et al. | 430/106 |
| 4,476,210 | 10/1984 | Croucher et al. | 430/114 |
| 4,525,307 | 6/1985 | Pratt | 252/35 X |
| 4,526,852 | 7/1985 | Herrmann et al. | 430/115 |
| 4,639,492 | 1/1987 | Makhlouf et al. | 260/97 X |
| 4,680,057 | 7/1987 | Hays | 106/23 |
| 4,681,831 | 7/1987 | Larson et al. | 430/114 |
| 4,702,984 | 10/1987 | El-Sayed et al. | 430/115 |

*Primary Examiner*—Roland E. Martin

*Attorney, Agent, or Firm*—E. O. Palazzo

[57] ABSTRACT

Disclosed is an improved liquid developer composition comprised of an oil base comprised of Magiesol, pigment particles, a dispersant, and a thickener component.

31 Claims, No Drawings

LIQUID DEVELOPER COMPOSITIONS

BACKGROUND OF THE INVENTION

This invention is generally directed to developer compositions especially liquid developers with excellent image drying times. More specifically, the present invention is directed to liquid developer compositions comprised of an oil base, a pigment, a dispersant, and a thickener component. Thus, in one important embodiment of the present invention there are provided liquid inks with rapid drying times, and acceptable transfer efficiencies, which inks contain in addition to a Magiesol oil base, pigments, including colored pigments, a thickener, and a polymeric dispersant. In a further embodiment of the present invention there are provided liquid ink compositions comprised of an oil base component; black or colored pigment particles, inclusive of cyan, magenta, and yellow; a dispersant; a thickener; and an optional inorganic filler viscosity control additive. The liquid ink compositions of the present invention can be selected for the development of images in various processes, including the liquid development process as described in U.S. Pat. No. 3,084,043, the disclosure of which is totally incorporated herein by reference; xerographic processes, electrographic recording, electrostatic printing, and facsimile systems.

Liquid developer compositions are known, reference for example U.S. Pat. No. 3,806,354, the disclosure of which is totally incorporated herein by reference. This patent illustrates liquid inks comprised of one or more liquid vehicles, colorants such as pigments and dyes, dispersants, and viscosity control additives. Examples of vehicles disclosed in the aforementioned patent are mineral oils, mineral spirits, and kerosene; while examples of colorants include carbon black, oil red, and oil blue. Dispersants described in this patent include materials such as alkylated polyvinyl pyrrolidones. Additionally, there are illustrated in U.S. Pat. No. 4,476,210, the disclosure of which is totally incorporated herein by reference, liquid developers containing an insulating liquid dispersion medium with marking particles therein, which particles are comprised of a thermoplastic resin core substantially insoluble in the dispersion, an amphipathic block or graft copolymeric stabilizer irreversibly chemically, or physically anchored to the thermoplastic resin core, and a colored dye imbibed in the thermoplastic resin core. The history and evolution of liquid developers is provided in the '210 patent, reference columns 1 and 2 thereof.

Other prior art includes U.S. Pat. No. 4,425,418, which discloses liquid developers for electrophotography comprising a coloring agent, a charge control agent, and one or more of a polyethylene, polypropylene, an ethylene copolymer and a propylene copolymer in an electro-insulating liquid. This patent also discloses inks with hydrocarbon resins soluble in a hydrocarbon solvent and a 1,3-pentadiene moiety in the electro-insulating liquid, and wherein carbon black can be selected as one of the possible coloring agents incorporated into the developer, see column 2, beginning at line 25, for example; U.S. Pat. No. 4,526,852 wherein there is disclosed liquid developers with negatively charged toner particles comprising a carrier liquid of high electric resistivity and low dielectric constant, pigments or dyes, and N-vinyl pyrrolidone containing polymer and at least one wax which is readily soluble in a carrier liquid at high temperatures but not soluble at room temperatures, reference column 2, beginning at line 24, and the teachings in column 2, beginning at line 39; and U.S. Pat. No. 3,939,087, which illustrates liquid toners containing finely divided pigments such as carbon black, a dye, and a hydrophobic agent suspended in a hydrocarbon fluid containing a dissolved polymer, which hydrophobic agent can be a silane treated fumed silica, reference column 2, lines 8 to 18.

Although the above described liquid inks are suitable for their intended purposes there remains a need for new liquid developers. More specifically, there is a need for liquid developers with improved drying times, acceptable transfer efficiencies, and desirable conductivity values. There also is a need for colored liquid developers which possess many of the aforementioned characteristics. Additionally, there is a need for economical liquid developer compositions that permit images of excellent resolution in a number of known imaging processes, including those illustrated in U.S. Pat. No. 3,084,043, the disclosure of which is totally incorporated herein by reference. Moreover, there is a need for liquid developers wherein the colorants selected are suitably dispersed, thus enabling black or colored images of excellent resolution. Further, there remains a need for liquid developers wherein the thickeners normally used can be replaced, in whole, or in part with inorganic viscosity control additives. In addition, there is a need for liquid inks with acceptable fixing properties to substrates such as paper, that is for example the developed images dry rapidly and do not smear or offset within, for example, about 20 seconds subsequent to development. Furthermore, there is a need for ink compositions with viscostatic properties, that is the viscosity is not altered by greater than about 15 to about 20 percent at 32° C. thus permitting the ink compositions to be acceptably deposited from gravure printing rollers while enabling images of high quality and excellent resolution, that is with not background deposits, over different temperature ranges. There also is a need for liquid inks which are useful with dielectric papers.

SUMMARY OF THE INVENTION

It is an object of the present invention to provide improved liquid developer compositions.

In another object of the present invention there are provided black and colored liquid developer compositions which can be selected for use in several different imaging systems, and which inks may also be used with dielectric papers in certain situations.

In yet another object of the present invention there are provided liquid developer compositions with excellent drying times and acceptable transfer efficiencies.

It is an additional object of the present invention to provide liquid developer compositions with specific dispersants, and specific oil base components.

Furthermore, in another object of the present invention there are provided liquid developer compositions with cyan, magenta, or yellow pigments.

Another object of the present invention resides in liquid developer compositions with inorganic fillers enabling compositions with controlled viscosity values, and with resistivities of from about $10^9$ to about $10^{11}$ ohm-cm.

Further, in another object of the present invention there are provided liquid developer compositions wherein dyes are used as the colorants.

Another object of the present invention is to provide inks with viscostatic characteristics, that is the viscosity is not modified by more than 15 percent between 20 and 32° C.

These and other objects of the present invention are accomplished by providing certain liquid developer compositions. More specifically, in one embodiment the present invention is directed to liquid developer compositions comprised of an oil base component of Magiesol, especially Magiesol 60, black, or colored pigment particles, a dispersant of OLOA 1200, a polyisobutylene succinimide, commercially available form Chevron Chemical Company, and a polyisobutylene based thickener. In one specific embodiment of the present invention there are provided liquid developer compositions comprised of from about 50 percent to about 90 percent by weight of the oil base component Magiesol 60, from about 4 percent to about 20 percent by weight of black or colored pigment particles or dyes, from about 2 percent to about 15 percent by weight of the dispersant OLOA 1200, a polyisobutylene succinimide, commercially available from Chevron Chemical Company, and from about 4 percent to about 35 percent by weight of a polyisobutylene thickener.

Examples of oil base components present in an amount of from about 50 percent by weight to about 90 percent by weight include Magiesols, especially Magiesol 60, primarily because of its low viscosity; and in some embodiments Isopars. In addition, Magiesol 60 is a highly refined petroleum distillate which has essentially a zero vapor pressure; is water white; and possesses a viscosity of about 8 centipoises at ambient temperature. The aforementioned Magiesol 60 also absorbs rapidly into a variety of bond papers thus enabling rapid drying characteristics for these inks.

Illustrative examples of dispersants present in an amount of from about 2 percent by weight to about 15 percent by weight, and preferably present in an amount of from about 4 percent by weight to about 12 percent by weight are OLOA 1200, a commercially available polyisobutylene succinimide, and the like. The aforementioned OLOA 1200 is preferred as a dispersant primarily since it is known to possess excellent stabilizer characteristics, especially for carbon black pigments, and moreover it is chemically compatible with the polymeric thickener component incorporated into the liquid developer inks of the present invention, which thickeners are as illustrated herein.

Thickeners that can be selected for the liquid developer compositions of the present invention, present in an amount of from about 4 percent by weight to about 35 percent by weight, include a polyisobutylene, commercially available as Kalene 800 from Hardman Company, New Jersey; ECA 4600, available from Exxon; and the like. Preferred thickeners incorporated into the liquid developers of the present invention are ECA 4600 and Kalene 800, which is believed to be a poly(isobutylene-co-isoprene) copolymer; which thickeners are also beleived to be of an average molecular weight of less than about 75,000 thereby assisting in maintaining the image drying times for a period of time of less than 1 minute. Specifically, it is believed that the ECA 4600 has a molecular weight of about 4,600 while the Kalene 800 has a molecular weight of about 40,000. Moreover, the aforementioned thickeners are compatible with the dispersant selected thereby enabling colloidally stable ink compositions, and further these thickeners are absorbed into paper. Additionally, the thickeners selected for the inks of the present invention can cause an increase in the viscosity of the Magiesol oil base incorporated into the ink composition as the temperature increases thereby imparting the viscostatic properties illustrated herein to the resulting developer compositions.

There also can be selected for the liquid developers of the present invention primarily as a partial replacement for the thickener component inorganic additive pigments present in an amount of from about 0.5 percent by weight to about 8 percent by weight, and preferably present in an amount of from about 1 percent by weight to about 5 percent by weight, such as silicas, including Aerosil 130, Aerosil 200 and Aerosil 300, available from Degussa Chemical; and clays, including Bentone 500 clay from NL Products. These inorganic additive pigments, which are hydrophilic, readily release oil thereby permitting the liquid ink compositions of the present invention to dry at a more rapid rate of time, that is in a period of from about 5 seconds to about 25 seconds.

Pigment particles or colorants present in an amount of from, for example, about 4 percent by weight to about 20 percent by weight, and preferably present in an amount of from about 6 percent by weight to about 15 percent by weight that can be selected for the developers of the present invention are carbon blacks, especially Printex 140V, Printex 150, Printex A, and Printex 45, available from Degussa; cyan, magenta, or yellow pigments, and mixtures thereof; and other similar pigments.

Illustrative examples of magenta materials that may be selected as pigments include, for example, Lithol Scarlett and Hostaperm Pink E, 2,9-dimethyl-substituted quinacridone and anthraquinone pigment identified in the color index as Cl 60710; Cl Dispersed Red 15, diazo pigment identified in the color index as Cl 26050; Cl Solvent Red 19; and the like. Illustrative examples of cyan materials that may be used as pigments include Sudan Blue OS, copper tetra-4(octadecyl sulfonamido) phthalocyanine, X-copper phthalocyanine pigment listed in the color index as Cl 74160, Cl Pigment Blue, and Anthrathrene Blue, identified in the color index as Cl 69810, Special Blue X-2137, and the like; while illustrative examples of yellow pigments that may be selected are Pigment Yellow FGL, Pigment Yellow 97, diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the liquid developer compositions in various suitable effective amounts, as indicated herein, providing the objectives of the present invention are achieved. In one preferred embodiment, these colored pigment particles can be present in the toner composition in an amount of from about 2 percent by weight to about 15 percent by weight calculated on the weight of the ink. Moreover, the inorganic pigments selected should enable the rapid release of the Magiesol base oil thereby contributing to the rapid drying times of the resulting developed images; and should possess acceptable tinting strengths and enable low viscosity ink dispersions as indicated herein. Accordingly, preferred colorants include the Printex blacks available from Degussa since they permit rapid drying times of, for example,less than 25 seconds.

Several advantages are provided with the ink compositions of the present invention as illustrated hereinbefore inclusive of the fast drying times described, and wherein there are obtained images of excellent resolution, for example, of from about 4 to about 6 line pairs per millimeter. Moreover, the ink compositions of the present invention are substantially odorless and viscostatic as illustrated herein, and possess substantially no undesirable time dependent rheological effects which may alter the imaging performance of the ink compositions. Furthermore, the inks of the present invention have excellent drying times in most situations less than about 25 seconds subsequent to removal from the imaging apparatuses, and such images are substantially smudgeproof, that is no smearing of the resulting image occurs during handling by individuals.

The liquid developer compositions of the present invention are useful for enabling the development of black and colored electrostatic latent images, particularly those contained on an imaging member charged negatively or positively. Examples of imaging members that may be selected are various known inorganic and organic photoreceptors including layered photoreceptors. Illustrative examples of layered photoresponsive devices include those with a substrate, a photogenerating layer, and a transport layer as disclosed in U.S. Pat. No. 4,265,990, the disclosure of which is totally incorporated herein by reference. Examples of photogenerating layer pigments are trigonal selenium, metal phthalocyanines, metal free phthalocyanines, and vanadyl phthalocyanines. Transport material examples include various aryl amines dispersed in resinous binders. Other organic photoresponsive materials that may be utilized in the practice of the present invention include polyvinyl carbazole, 4-dimethylaminobenzylidene; 2-benzylidene-aminocarbazole, (2-nitro-benzylidene)-p-bromoaniline; 2,4-diphenylquinazoline; 1,2,4-triazine; 1,5-diphenyl-3-methyl pyrazoline 2-(4'-dimethyl-amino phenyl)-benzoxazole; 3-amino-carbazole; polyvinylcarbazole-tritrofluorenone charge transfer complex; and mixtures thereof. Further, inorganic imaging members that can be selected are selenium and selenium alloys, zinc oxide, cardmium sulfide, hydrogenated amorphous silicon, as well as iongraphic surfaces of various dielectric materials such as polycarbonates, polysulfone fluoropolymers, anodized aluminum alone or filled with wax expanded fluoropolymers.

The following examples are being supplied to further define specific embodiments of the present invention, it being noted that these examples are intended to illustrate and not limit the scope of the present invention. Parts and percentages are by weight unless otherwise indicated. Also, unless otherwise indicated the transfer efficiency was determined gravimetrically as detailed in Example I.

EXAMPLE I

An ink composition containing 73.8 percent of Magiesol 60, 8.0 percent of Printex 140V carbon black, 8.1 percent of OLOA 1200 and 10.1 percent of Kalene 800 was prepared by placing the components in a Union Process 01 attritor together with ¼ inch stainless steel balls and attriting the material at room temperature for 2 hours. A dispersion with a viscosity of 250 centipoises (cp) at room temperature, which decreased to 235 cp at 32° C., was obtained. In addition, the average particle diameter size of the resulting ink particles was 0.2 micron, the resistivity of the ink was $3\times10^{10}$ ohm-cm, and they were of a neutral polarity. Upon imaging using an experimental breadboard electrostatic imaging apparatus with a gravure roll of 200 lines/inch and an organic photoreceptor comprised of an aluminum substrate, a photogenerating layer of trigonal selenium, 90 percent by weight, dispersed in 10 percent by weight of polyvinylcarbazole, and thereover a transport layer of N,N'-diphenyl-N,N'bis(3-methylphenyl)1,1'-biphenyl-4,4'-diamine, 55 percent by weight dispersed in 45 percent by weight of the polycarbonate resin Makrolon, reference U.S. Pat. No. 4,265,290, the disclosure of which is totally incorporated herein by reference, images of an optical density 1.2 were obtained on Xerox 4024 paper with a resolution of 6 line pairs per millimeter. The optical density was measured using a Macbeth densitometer and the resolution was read off of a resolution target. These images could be further processed without rub-off or offset within 20 seconds subsequent to exiting from the imaging breadboard. The rub-off was measured by rubbing the newly formed image with a pencil eraser while the offset was measured by placing a clean piece of paper over the imaged area and pressing a rubber stamp normal to the paper surface with a pressure of 10 pounds per square inch. The transfer efficiency of the ink was obtained by measuring the amount of ink developed on the photoreceptor, and more specifically by imaging on the photoreceptor and subsequently wiping the ink therefrom with a sponge of a known weight. The increase in weight of the sponge was then measured, and thereafter the photoreceptor was again imaged. This second image was then transferred to paper and the ink remaining on the photoreceptor after transfer to paper was measured using a sponge of a known weight. The percent transfer efficiency was then defined as the weight of ink transferred to paper by the weight of ink imaged on the photoreceptor, and the weight of ink imaged on the photoreceptor minus the weight of ink obtained from the weight gain of the sponge on the photoreceptor after transfer divided by the weight of the inked images on the photoreceptor. The transfer efficiency was found to be 62 percent for the aforementioned prepared ink composition.

EXAMPLE II

An ink composition containing 56.9 percent Magiesol 60, 8.8 percent Printex 140V, 8.8 percent OLOA 1200 and 25.5 percent ECA 4600 was prepared by attriting for two hours these components in a Union Process 01 attritor with ¼ inch stainless steel balls. An ink dispersion with a viscosity of 262 cp at ambient temperature was obtained, which decreased to 240 cp at 32° C. The primary average particle diameter size of the ink particles was found to be about 0.2 μm (microns), the resistivity of the ink was about $4\times10^{10}$ ohm-cm, and the ink particles were found to be of a neutral polarity. Upon imaging with the experimental breadboard as described in Example I, images with an optical density of 1.1 were obtained on Xerox 4024 paper. The image resolution was 6 line pairs per millimeter. Also, the resultant images could be handled without rub-off or offset within 20 seconds subsequent to exiting from the breadboard. The transfer efficiency of the resulting ink from the photoreceptor to paper was measured gravimetrically and found to be 63 percent.

EXAMPLE III

An ink composition containing 55.0 percent Magiesol 60, 9.2 percent Printex 150, 8.1 percent OLOA 1200, and 27.7 percent ECA 4600 was prepared by attriting for 3 hours these components in a Union Process 01 attritor using ¼ inch stainless steel balls. An ink composition with a viscosity of 238 cp at ambient temperature was obtained, which decreased to 210 cp at 32° C. The primary average particle diameter size of the resulting ink particles was about 0.2 μm, the resistivity was $4\times10^{10}$ ohmcm, and the resulting ink particles were of a neutral polarity. Upon imaging using the experimental breadboard as described in Example I, images of optical density 1.1 were obtained with a resolution of 5 line pairs per millimeter. These images were found to be dry without rub-off or offset within 20 seconds subsequent to exiting from the breadboard. The transfer efficiency of this ink was 63 percent.

EXAMPLE IV

An ink composition containing 74.0 percent Magiesol 60, 8.0 percent Printex 45, 8.0 percent OLOA 1200, and 10.0 percent Kalene 800 was prepared ball milling by repeating the procedure of Example III. An ink dispersion with a viscosity of 262 cp at ambient temperature, which decreased to 240 cp at 32° C., was obtained. The primary average particle diameter size of the ink particles was 0.3 μm, the resistivity of the ink was $6\times10^{10}$ ohm-cm, and the ink particles were neutral. Upon imaging as described in Example I, images of an optical density of 1.2 were obtained with a resolution of 5 line pairs per millimeter on Xeox 4024 paper. The images were dry to the touch within 20 seconds after exiting from the imaging breadboard, and the transfer efficiency was measured gravimetrically and found to be 58 percent.

EXAMPLE V

An ink composition containing 54.6 percent Magiesol 60, 9.0 percent Printex A, 8.2 percent OLOA 1200, and 28.2 percent ECA 4600 was prepared by attrition by repeating the procedure of Example III. An ink dispersion with a viscosity at ambient temperature of 251 cp was obtained, which decreased to 238 cp at 32° C. The primary average particle size diameter of the ink particles was found to be 0.3 μm, the resistivity of the ink was $4\times10^{10}$ ohm-cm, and the ink particles were electrostatically neutral. Upon imaging as described in Example I, images of an optical density of 1.1 with a resolution of 4 line pairs per millimeter were obtained on Xerox 4024 paper. The images were able to be handled without rub-off or offset within 20 seconds after being imaged. The transfer efficiency of these inks measured gravimetrically were 61 percent.

EXAMPLE VI

An ink composition containing 67.2 percent Magiesol 60, 9.9 percent Printex 140V, 6.5 percent OLOA 1200, 14.6 percent ECA 4600, and 1.8 percent Bentone 500 was prepared by attriting the ink components in a Union Process 01 attritor using ¼ inch stainless steel balls for 3 hours. An ink dispersion with a viscosity of 250 cp at ambient temperature, which decreased to 238 cp at 32° C., was obtained. The primary average particle size diameter of the ink particles was 0.3 μm, the resistivity of the ink was $1\times10^{10}$ ohm-cm, and the ink particles were neutral. Upon imaging using the experimental breadboard as described in Example I, images with an optical density of 1.2 were obtained on Xerox 4024 paper with a resolution of 5 line pairs per millimeter. The images were fixed to the 4024 paper within 20 seconds of exiting from the breadboard. The transfer efficiency of the ink was obtained gravimetrically and found to be 64 percent.

EXAMPLE VII

An ink composition containing 74.5 percent Magiesol 60, 8.4 percent Printex 140V, 7.5 percent OLOA 1200, 7.2 percent Kalene 800, and 2.4 percent Aerosil 130 was prepared by attriting the components together in a Union Process 01 attritor using ¼ inch stainless steel balls for 3 hours. An ink dispersion with a viscosity of 340 cp at ambient temperature, which decreased to 310 cp at 32° C., was obtained. The primary average particle diameter of the ink particles was 0.4 μm, the resistivity of the ink was found to be $3.4\times10^{10}$ ohm-cm, and the ink particles were of a neutral polarity. Upon imaging in the experimental breadboard as described in Example I, images with solid area densities of 1.1 were obtained with a resolution of 4 line pairs per millimeter. The images were well fixed to 4024 paper, that is there was no smearing or offsetting of the ink within 20 seconds of exiting from the breadboard. The transfer efficiency of the ink was 58 percent.

EXAMPLE VIII

An ink composition containing 72.0 percent Magiesol 60, 9.7 percent Lithol Scarlett, 7.6 percent OLOA 1200, and 10.7 percent Kalene 800 was prepared by attriting the components in a Union Process 01 attritor for 4 hours using ¼ inch stainless steel balls. An ink dispersion with a viscosity of 231 cp at ambient temperature, which decreased to 208 cp at 32° C., was obtained. The average primary particle diameter size of the ink particles was 0.5 μm, the resistivity of the ink was found to be $6\times10^{10}$ ohm-cm, and the ink particles were of a neutral polarity. Upon imaging in an experimental breadboard as described in Example I, magenta images with an optical density of 1.0 were obtained with a resolution of 5 line pairs per millimeter. The images were observed to be well fixed to the 4024 paper within 20 seconds of exiting from the breadboard, and the transfer efficiency of the ink was 56 percent.

EXAMPLE IX

An ink composition containing 71.6 percent Magiesol 60, 10.1 percent Sudan Blue OS, 7.6 percent OLOA 1200, and 10.7 percent Kalene 800 was prepared by attriting these components in a Union Process 01 attritor for 4 hours using ¼ inch stainless steel balls. An ink dispersion with a viscosity of 248 cp at ambient temperature, which decreased to 212 cp at 32° C., was obtained. The primary average particle diameter size of the ink particles was 0.4 μm, the resistivity of the ink was $5\times10^{10}$ ohm-cm, and the ink particles were of a neutral polarity. Upon imaging in the experimental breadboard of Example I, cyan images with an optical density of 1.0 were obtained with a resolution of 5 line pairs per millimeter. The images were observed to be well fixed to the 4024 paper within 20 seconds after exiting from the breadboard, and the transfer efficiency of the ink was 62 percent.

EXAMPLE X

An ink composition containing 72.0 percent Magiesol 60, 9.7 percent Hostaperm Pink E, 7.6 percent OLOA 1200, and 10.7 percent Kalene 800 was prepared by attriting the components in a Union Process 01 attritor for 4 hours using ¼ inch stainless steel balls. An ink dispersion with a viscosity of 24 cp at ambient temperature, which decreased to 215 cp at 32° C., was obtained. The primary average particle diameter size of the ink particles was 0.5 μm, the resistivity of the ink was to be $5\times10^{10}$ ohm-cm, and the ink particles were of a neutral polarity. Upon imaging in the experimental breadboard of Example I, magenta images with an optical density of 0.9 were obtained with a resolution of 5 line pairs per millimeter. The images were observed to be well fixed to the 4024 paper within 20 seconds of exiting from the breadboard, and the transfer efficiency of the ink was 59 percent.

EXAMPLE XI

An ink composition containing 72.0 percent Magiesol 60, 10.0 percent Permanent Yellow FGL, 7.7 percent OLOA 1200, and 10.3 percent Kalene 800 was prepared by attriting the components in a Union Process 01 attritor for 4 hours using ¼ inch stainless steel balls. An ink dispersion with a viscosity of 220 cp at ambient temperature, which decreased to 200 cp at 32° C., was obtained. The primary average particle diameter size of the ink particles was 0.5 μm, the resistivity of the ink was $4\times10^{10}$ ohm-cm, and the ink particles were of a neutral polarity. Upon imaging in the experimental breadboard of Example I, yellow images with an optical density of 1.0 were obtained with a resolution of 5 line pairs per millimeter. The images were observed to be well fixed to the 4024 paper within 20 seconds of exiting from the breadboard, and the transfer efficiency of the ink was 62 percent.

EXAMPLE XII

An ink composition containing 80.0 percent Magiesol 60, 10.0 percent Printex 140V, 7.0 percent OLOA 1200, and 3.0 percent Vistanex L-80, which is a high molecular weight (greater than 200,000) polyisobutylene available from Exxon was prepared by placing the components in a Union Process 01 attritor together with ¼ inch stainless steel balls and attriting the material at room temperature for 2 hours. An ink dispersion with a viscosity of 340 cp at ambient temperature, which decreased to 285 cp at 32° C., was obtained. The primary average particle diameter size was 0.3 μm, and the resistivity of the ink was $8\times10^{10}$ ohmcm. Also the ink particles were of a neutral polarity. Upon imaging using the experimental breadboard, images of optical density of 1.1 were obtained on Xerox 4024 paper. These images were only able to be handled without rub-off or offset 2 minutes after exiting from the imaging breadboard. The transfer efficiency of this ink was 56 percent.

EXAMPLE XIII

An ink composition containing 78.8 percent Magiesol 60, 10.2 percent Lithol Scarlet, 8.8 percent OLOA 1200, and 2.2 percent Vistanex LM-MH, which is a high molecular weight polyisobutylene available from Exxon, was prepared by attriting these components in a Union Process 01 attritor using ¼ inch stainless steel balls. The attrition time was approximately 2 hours. An ink dispersion with a viscosity of 248 cp at ambient temperature was obtained, which decreased to 200 cp at 32° C. The primary particle size was found to be about 0.2 μm, the resistivity of the ink was about $6\times10^{10}$ ohm-cm, and the ink particles were of a neutral polarity. Upon imaging with the experimental breadboard as described in Example I, images with an optical density of 1.0 were obtained on Xerox 4024 paper. The image resolution was about 4 line pairs per millimeter. The images were only able to be handled without rub-off or offset 2 minutes after exiting from the breadboard. The efficiency of transfer of ink from the photoreceptor to paper was measured gravimetrically and found to be 56 percent. A similar ink with a low molecular weight polyisobutylene could be fixed within 20 seconds.

Other modifications of the present invention will occur to those of ordinary skill in the art subsequent to a review of the present application, and these modifications are intended to be included within the scope of this invention.

What is claimed is:

1. An improved liquid developer composition comprised of a Magiesol oil base, pigment particles, a dispersant, and a thickener component selected from the group consisting of polyisobutylene and poly(isobutyl-co-isoprene)copolymer.

2. An improved developer composition in accordance with claim 1 wherein the oil base is Magiesol 60.

3. An improved developer composition in accordance with claim 1 wherein the dispersant is a polyisobutylene succinimide.

4. A composition in accordance with claim 1 wherein the pigment particles are carbon black.

5. A composition in accordance with claim 1 wherein the pigment particles are selected from the group consisting of cyan pigment particles, magenta pigment particles, yellow pigment particles; and mixtures thereof.

6. An improved liquid developer composition comprising a Magiesol oil base, pigment particles, a dispersant, and a thickener component, wherein the thickener is polyisobutylene.

7. An improved liquid developer composition comprising a Magiesol oil base, pigment particles, a dispersant, and a thickener component, wherein the thickener is poly(isobutyl-co-isoprene)copolymer.

8. A composition in accordance with claim 1 wherein the Magiesol is present in an amount of from about 50 percent by weight to about 90 percent by weight, the pigment particles are present in an amount of from about 4 to about 20 percent by weight, the dispersant is present in an amount of from about 2 to about 15 percent by weight, and the thickener is present in an amount of from about 4 to about 35 percent by weight.

9. A composition in accordance with claim 1 wherein the thickener component selected has an average molecular weight of less than about 75,000.

10. A composition in accordance with claim 1 wherein the thickener is of a molecular weight of from about 5,000 to 40,000.

11. A composition in accordance with claim 1 wherein the drying time of the resulting developer is from about 5 seconds to about 25 seconds.

12. A composition in accordance with claim 1 wherein the viscosity of the developer composition is from about 150 to about 350 centipoises.

13. A composition in accordance with claim 1 further including therein an inorganic additive component.

14. A method of accomplishing the development of electrostatic latent images which comprises the formation of the aforementioned image on an imaging member, subsequently developing this image with the developer composition of claim 1, and thereafter transferring the developed image to a suitable substrate.

15. A method of imaging in accordance with claim 14 wherein the oil base for the developer is Magiesol 60.

16. A method of imaging in accordance with claim 14 wherein the dispersant is a polyisobutylene succinimide.

17. A method of imaging in accordance with claim 14 wherein the pigmment particles are carbon black.

18. A method of imaging in accordance with claim 14 wherein the pigment particles are selected from the group consisting of cyan pigment particles, magenta pigment particles, yellow pigment particles; and mixtures thereof.

19. A method of developing electrostatic latent images which comprises the formation of the aforementioned image on an imaging member, subsequently developing this image with a liquid developer composition comprising a Magiesol oil base, pigment particles, a dispersant, and a thickener component, and thereafter transferring the developed image to a suitable substrate, wherein the thickener is polypolyisobutylene.

20. A method of developing electrostatic latent images which comprises the formation of the aforementioned image on an imaging member, subsequently developing this image with a liquid developer composition comprising a Magiesol oil base, pigment particles, a dispersant, and a thickener component, and thereafter transferring the developed image to a suitable substrate, wherein the thickener is poly(isobutyl-co-isoprene) copolymer.

21. A method of imaging in accordance with claim 14 wherein the Magiesol is present in an amount of from about 50 percent by weight to about 90 percent by weight, the pigment particles are present in an amount of from about 4 to about 20 percent by weight, the dispersant is present in an amount of from about 2 to about 15 percent by weight, and the thickener is present in an amount of from about 4 to about 35 percent by weight.

22. A method of imaging in accordance with claim 14 wherein the thickener component selected has an average molecular weight of less than about 75,000.

23. A method of imaging in accordance with claim 14 wherein the thickener is of a molecular weight of between about 5,000 and about 40,000.

24. A method of imaging in accordance with claim 14 wherein the drying time of the resulting developer is from about 5 seconds to about 25 seconds.

25. A method of imaging in accordance with claim 14 wherein the viscosity of the developer composition is from about 150 to about 350 centipoises.

26. A method of imaging in accordance with claim 14 wherein the developer further includes therein an inorganic additive component.

27. A method of imaging in accordance with claim 14 wherein the developer is comprised of an oil base selected from the group consisting of Magiesol and Isopar, pigment particles, a dispersant of polyisobutylene succinimide, and an inorganic additive filler.

28. A method of imaging in accordance with claim 14 wherein there results images that are substantially smudgeproof.

29. A composition in accordance with claim 1 wherein the pigment particles are carbon black selected from the group consisting of Printex 140V, Printex 150, Printex A, and Printex 45.

30. A composition in accordance with claim 1 wherein the pigments are selected from the group consisting of Lithol Scarlett, Hostaperm Pink, anthraquinones, and quinacridones.

31. A composition in accordance with claim 1 wherein the pigments are selected from the group consisting of Sudan Blue, Permanent Yellow, carbon black, and mixtures thereof.

* * * * *